US005720398A

United States Patent [19]

Kump et al.

[11] Patent Number: 5,720,398

[45] Date of Patent: Feb. 24, 1998

[54] POWER WING CLIP

[75] Inventors: Daniel J. Kump, Mentor; Joseph P. Kosir, Cleveland, both of Ohio

[73] Assignee: Fasteners For Retail, Inc., Cleveland, Ohio

[21] Appl. No.: 711,670

[22] Filed: Sep. 4, 1996

[51] Int. Cl.[6] ..... A47F 5/00

[52] U.S. Cl. ..... 211/113; 211/149; 211/186; 211/126.16; 248/215; 248/301; 248/231.81; 248/316.7

[58] Field of Search ..... 211/113, 149, 211/126.16, 126.6, 186; 248/51, 74, 2, 215, 231.81, 231.31, 301, 316.7, 174

[56] References Cited

U.S. PATENT DOCUMENTS

| | | | |
|---|---|---|---|
| 1,856,847 | 5/1932 | Gates | 248/301 X |
| 2,811,328 | 10/1957 | Ericson | 248/301 X |
| 3,019,954 | 2/1962 | Faltin | 248/316.7 X |
| 3,248,765 | 5/1966 | Achabal et al. . | |
| 3,297,815 | 1/1967 | Drettmann | 248/51 X |
| 3,599,918 | 8/1971 | Patchett | 248/215 X |
| 3,772,742 | 11/1973 | Gigante | 248/231.81 |
| 4,982,848 | 1/1991 | Church et al. . | |
| 5,509,632 | 4/1996 | Mesna et al. | 248/301 |

*Primary Examiner*—Robert W. Gibson, Jr.
*Attorney, Agent, or Firm*—Fay, Sharpe, Beall, Fagan, Minnich & McKee

[57] ABSTRACT

An integrally formed hanger fixture includes a substantially vertically oriented wall having a top end and a bottom end. A substantially horizontally oriented wall is connected to the top end of the vertical wall. A front retainer wall is connected to the bottom end of the vertically oriented wall and extends upwardly therefrom in a spaced substantially parallel manner. A wing overlies the horizontally oriented wall. A hinge connects the wing to the horizontally oriented wall. The hinge enables the wing to pivot in relation to the horizontally oriented wall until the wing is disposed beneath the horizontally oriented wall. A rear retainer wall is preferably connected to the bottom end of the vertically oriented wall and extends upwardly therefrom in a substantially parallel manner. The hanger fixture is used to hold a display rack to a store shelf.

20 Claims, 4 Drawing Sheets

POWER WING CLIP

BACKGROUND OF THE INVENTION

This invention relates to hanger fixtures for supporting display racks. More particularly, the invention relates to an integrally formed hanger fixture which can be secured to a store shelf and used for holding a display rack.

It is common in merchandising to use hanger fixtures or shelf extenders for presenting product literature, products or display racks of products for purchase. Some of the extenders are small plastic extruded clips having members which slidably fit into horizontally extending price channels secured onto display shelves or other supports. Lightweight goods for sale or advertisements which do not force the clip away from the price channel are then fitted by plastic connectors, hooks or other means onto the clip for display thereon.

Other shelf extenders and hanger fixtures are supported by a shelf or other supporting surface to give added stability and provide a stronger support for larger, heavier objects and display racks. It is known, for example, to use clamp extenders to retain larger and heavier objects as compared to the smaller clips prevalent in merchandising. However, the use of clamps is burdensome.

Other similar large extenders and hanger fixtures do not incorporate a clamp. However, many of these are not retained well on a shelf or have a structure mandating a complex wall design to ensure proper stability of a supported display rack or container. In addition, it is difficult to readily interconnect containers or display racks to many of the complex hanger fixtures.

Many of the known extenders and hanger fixtures extend substantially beyond the shelf to which they are affixed. Therefore, large vertically-oriented containers or display racks which are retained thereon often will swing freely relative to the hanger fixture without adequate support from the shelves or other vertical wall faces adjacent the display rack backside.

An integrally formed hanger fixture for supporting a display rack is also known. The hanger fixture is formed as an L-shaped bracket having substantially horizontal and substantially vertical walls. A retainer wall is connected to a lower portion of the vertical wall and extends upwardly therefrom in substantially parallel spaced relation to the vertical wall to define a gap between the vertical wall and the retainer wall. The retainer wall slides into a slot formed on a rear wall of the display rack. A pressure sensitive adhesive is positioned on the underside of the horizontal wall of the bracket for adhesively securing the hanger fixture to a support surface such as a display rack.

However, even this known hanger fixture is disadvantageous from a number of standpoints. First, the hanger, since it includes a layer of adhesive, is meant to be permanently secured to a store shelf. Second, the hanger fixture is generally not fastened to a vertically-oriented wall of the display shelf unless a secondary strip of adhesive is provided on the underside of the vertical wall of the bracket. Therefore, the hanger fixture can be detached from the vertical wall upon the removal of articles held in the display rack supported by the hanger fixture, or even by jostling of the display rack as a patron of the store brushes past the display rack. Third, no means is provided for positively locking the hanger fixture to the store shelf, when so desired, and unlocking the hanger fixture from the store shelf for ready detachability.

Accordingly, it has been considered desirable to develop a new and improved hanger fixture for holding display racks on store shelves which would overcome the foregoing difficulties and others while providing better and more advantageous overall results.

BRIEF SUMMARY OF THE INVENTION

In accordance with the present invention, a new and improved integrally formed hanger fixture is provided.

More particularly, the hanger fixture comprises a substantially vertically oriented wall having a top end and a bottom end. A substantially horizontally oriented wall is connected to the top end of the vertical wall. A front retainer wall is connected to the bottom end of the vertically oriented wall and extends upwardly therefrom in a spaced, substantially parallel manner. A wing overlies the horizontally oriented wall. A hinge connects the wing to the horizontally oriented wall wherein the hinge enables the wing to pivot in relation to the horizontally oriented wall until the wing is disposed beneath the horizontally oriented wall.

Preferably, a layer of a friction material is located on the wing. The hanger fixture can further include a rear retainer wall connected to the bottom end of the vertically oriented wall and extending upwardly therefrom in a spaced, substantially parallel manner. The rear retainer wall preferably comprises a top extension which is positioned below the vertically oriented wall. If desired, a layer of a friction material can be located on the top extension. The front retainer wall and the rear retainer wall can each terminate in a lip. Preferably, the hanger fixture is formed from a resilient material.

In accordance with another aspect of the invention, there is provided in combination a display rack including a substantially upright rear wall having at least one horizontal slot formed therein and a hanger fixture for supporting the display rack.

More particularly, the hanger fixture comprises a substantially vertically oriented wall having a top end and a bottom end. A substantially horizontally oriented wall is connected to the top end of the vertical wall and a front retainer wall is connected to the bottom end of the vertically oriented wall. The front retainer wall extends upwardly from the vertical wall in a spaced substantially parallel manner. A wing overlies the horizontally oriented wall. A hinge connects the wing to the horizontally oriented wall wherein the hinge enables the wing to pivot in relation to the horizontally oriented wall until the wing is disposed beneath the horizontally oriented wall. The front retainer wall is dimensioned to be readily received in and pass through the slot on the rear wall of the display rack to thus interconnect the rack and the hanger fixture.

One advantage of the present invention is the provision of a new and improved hanger fixture for supporting display racks.

Another advantage of the present invention is the provision of a hanger fixture which includes a wing that is pivotally mounted thereon. The wing is employed for selectively locking the hanger fixture to a store shelf.

Still another advantage of the present invention is a hanger fixture which is formed in a unitary manner from one or more types of thin resilient material so as to be inexpensive and easy to use.

Yet another advantage of the present invention is the provision of an L-shaped hanger fixture which can have both a horizontal wall and a vertical wall thereof selectively locked to and unlocked from a store shelf.

An additional advantage of the present invention is the provision of a hanger fixture which will tightly hold onto a store shelf to prevent dislodgement of the fixture and of a display rack mounted on the fixture.

A further advantage of the present invention is the provision of a hanger fixture which is not adhesively secured to store shelves and, therefore, will not cause adhesive damage or leave a layer of adhesive on a store shelf if the hanger fixture is removed.

A still further advantage of the present invention is the provision of a hanger fixture which includes friction layers on opposing surfaces of the fixture to prevent a sliding of the hanger fixture along the store shelf when the hanger fixture is secured to the store shelf.

Still other benefits and advantages of the invention will become apparent to those skilled in the art upon reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figure 1:
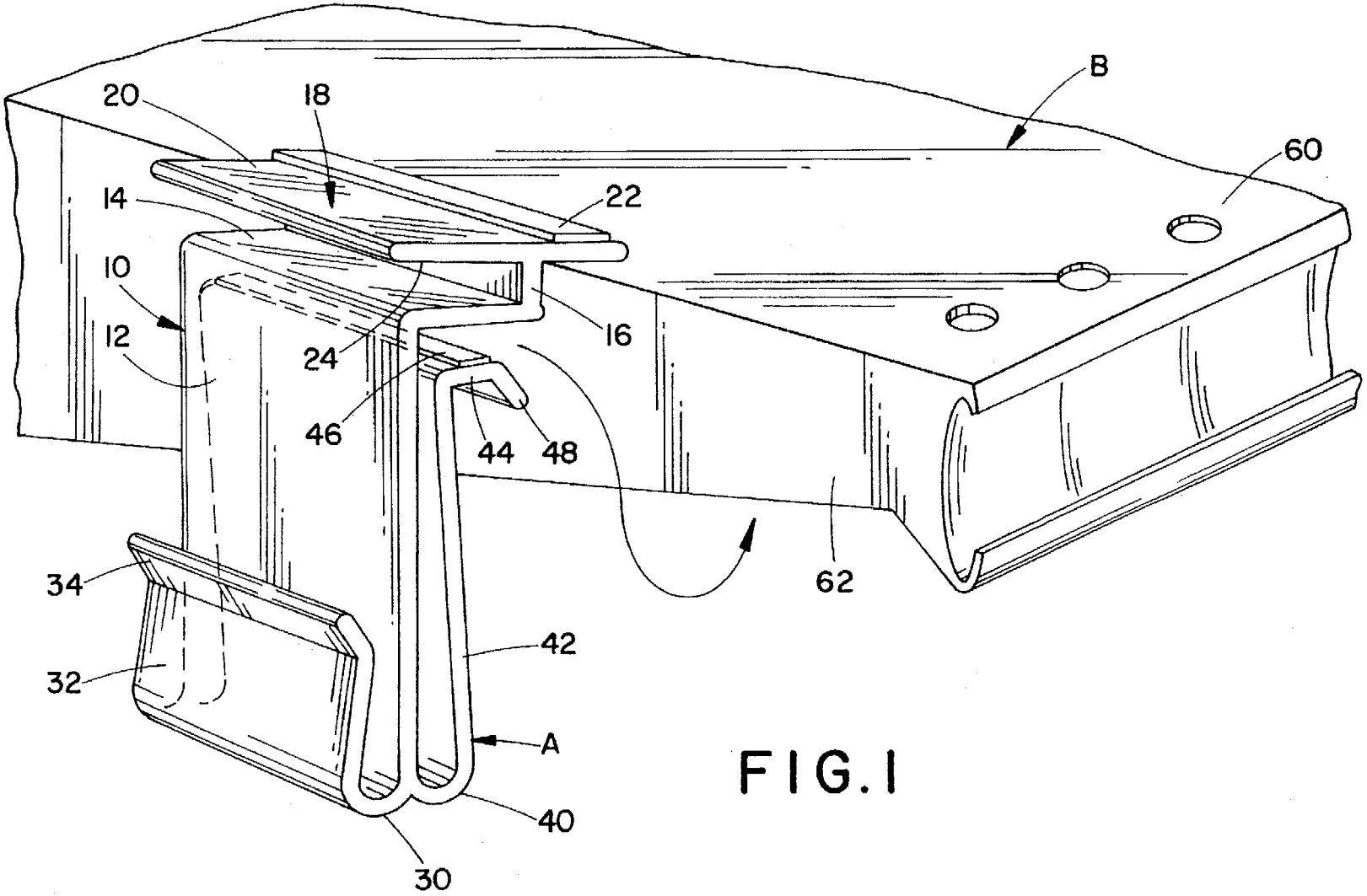
FIG. 1 is an exploded perspective view of a hanger fixture according to the present invention before it is secured to a store shelf.

Referring now to the drawings, wherein the showings are for purposes of illustrating a preferred embodiment of the invention only and not for purposes limiting same, FIG. 1 shows a hanger fixture A which can be selectively secured to a conventional store shelf B.

The hanger fixture comprises a hanger body having a vertical wall 12 and extending at approximately a right angle therefrom, a horizontal or top wall 14. Disposed at a free end of the top wall is a hinge 16 made from a resilient material. The hinge connects the top wall to a wing 18 which extends parallel to the top wall when the hinge is not in use. The wing has a first face 20 on which there is located a layer of friction material 22 and a second face 24 to which the hinge 16 is secured.

Figure 2A:
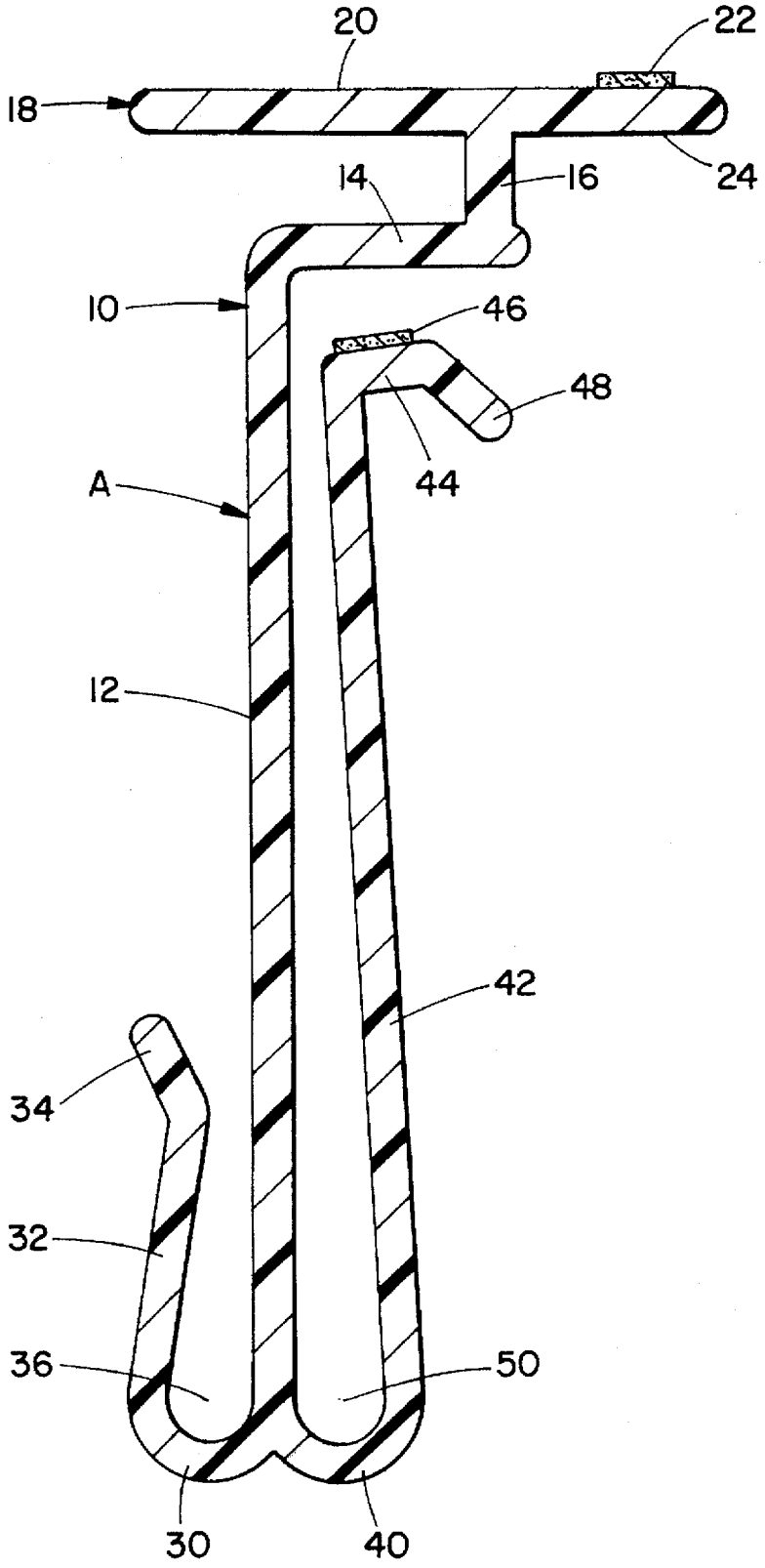
FIG. 2A is an enlarged side elevational view in cross-section of the hanger fixture of FIG. 1.

Located on a bottom end of the vertical wall 12 is a front bridge 30 which leads to a front retainer wall 32. The front wall extends approximately parallel to the vertical wall and terminates in an angled lip 34. With reference now to FIG. 2A, a slot 36 is defined between the front wall 32 and the vertical wall 12. Extending also from the bottom end of the vertical wall 12 is a rear bridge 40 which leads to a rear retainer wall 42. The rear wall extends approximately parallel to the vertical wall. It has a top extension 44 on one surface of which there is provided a layer 46 of a friction material. The top extension terminates in an angled lip 48. A slot 50 is defined between the rear wall 42 and the vertical wall 12.

While it is evident from FIG. 2A that the front wall 32 and the rear wall 42 are substantially parallel to the vertical wall 12, they are in each case angled slightly so that the upper ends thereof lie closer to the vertical wall 12 than do the lower ends thereof. Thus the slots 36 and 50 are somewhat tapered in the uninstalled condition of the hanger fixture A. It is also evident that the rear wall top end 44 is approximately parallel to but spaced from the top wall 14 of the hanger body.

Preferably the hanger fixture A is made from a suitable conventional resilient material such as a thermoplastic. The layers of friction material 22 and 46 and the hinge 16 can be made from one type of thermoplastic material whereas the remainder of the hanger fixture A can be made from a different type of thermoplastic material. Preferably, the thermoplastic materials are different types of polyvinylchloride (PVC). In the preferred embodiment, the hanger fixture A can be integrally produced by being extruded by a known co-extrusion process from the different thermoplastic materials. Since the hinge is made from a suitable resilient material, it has a memory and will maintain its unstressed condition illustrated in FIG. 1 before the hanger fixture A is assembled to the shelf B. The hinge 16 will return to its unstressed condition when the hanger fixture is disassembled from the shelf B.

Figure 2D:
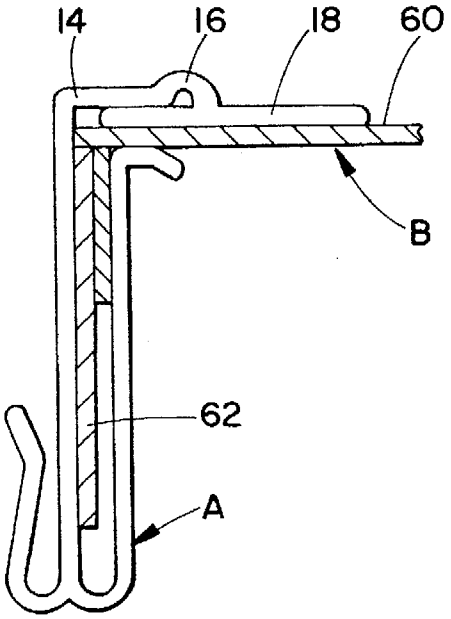
FIGS. 2B–2D are side elevational views of the hanger fixture of FIG. 2A in the process of being installed on the store shelf of FIG. 1.
Figure 2C:
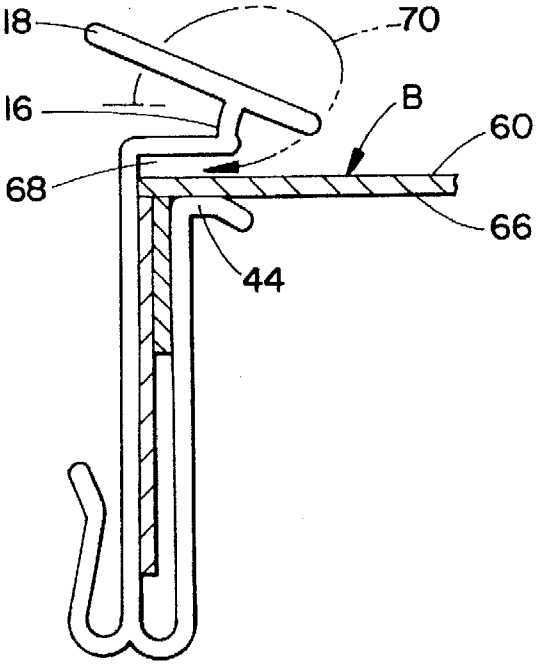
Figure 2B:
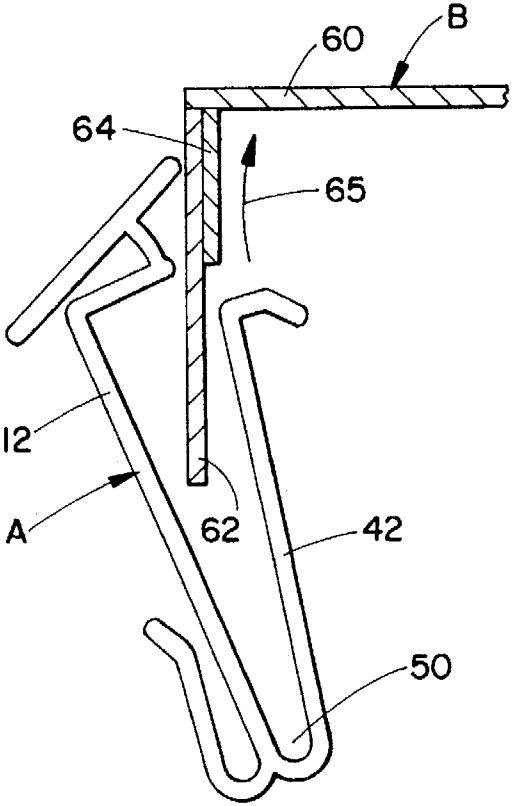

With reference now to FIGS. 2B–2D, the process of installing the hanger fixture A on the store shelf B is there illustrated. FIG. 2B shows that the store shelf includes a top wall 60 and a side wall 62. The side wall is shown to have a reinforced upper section 64. In order to secure the hanger fixture A to the store shelf B, the rear wall 42 thereof is pushed away from the vertical wall 12. This allows the hanger fixture A to be moved upwardly, in the direction of arrow 65 enabling the side wall 62 of the store shelf B to protrude into the slot 48 between the vertical wall 12 and the rear wall 42.

Once the top wall 14 of the hanger fixture A clears the top wall 60 of the store shelf B, the hanger fixture can be rotated clockwise so that the hanger fixture top wall overlies the store top wall as is illustrated in FIG. 2C. The hanger fixture is then moved upwardly until the rear wall top extension 44 contacts a bottom side 66 of the store shelf top wall 60. When this is accomplished, there is created a gap 68 between the hanger body top wall and the store shelf top wall. At this time, the wing 18 of the hanger fixture can be rotated clockwise around the hinge 16 in relation to the top wall 14 of the hanger fixture as is illustrated by the dashed arrow 70.

Due to the resilient nature of the thermoplastic material from which the hinge 16 is made, the wing 18 can be rotated 180° around the top wall 14 so that the wing can be made to lie beneath the top wall as is illustrated in FIG. 2D. The wing is suitably sized in thickness so as to underlie the top wall 14 and serve as a locking means for locking the hanger fixture A to the store shelf B as is illustrated in FIG. 2D.

The friction surfaces 22 and 46 prevent a sliding movement of the hanger fixture A along the shelf B. In other words, the hanger fixture A is not able to be easily slid in relation to the shelf side wall 62. For this purpose, the two friction surfaces 22 and 46 face each other on opposed sides of the shelf top wall 60 in FIG. 2D. The spacing between the wing 18 and the top extension 44, when the wing is folded over as shown in FIG. 2D, is sized to accommodate the thickness of the shelf top wall 60. With different thicknesses of the shelf top wall, different spacings will be necessary between the wing 18 and the top extension 44.

Figure 3:
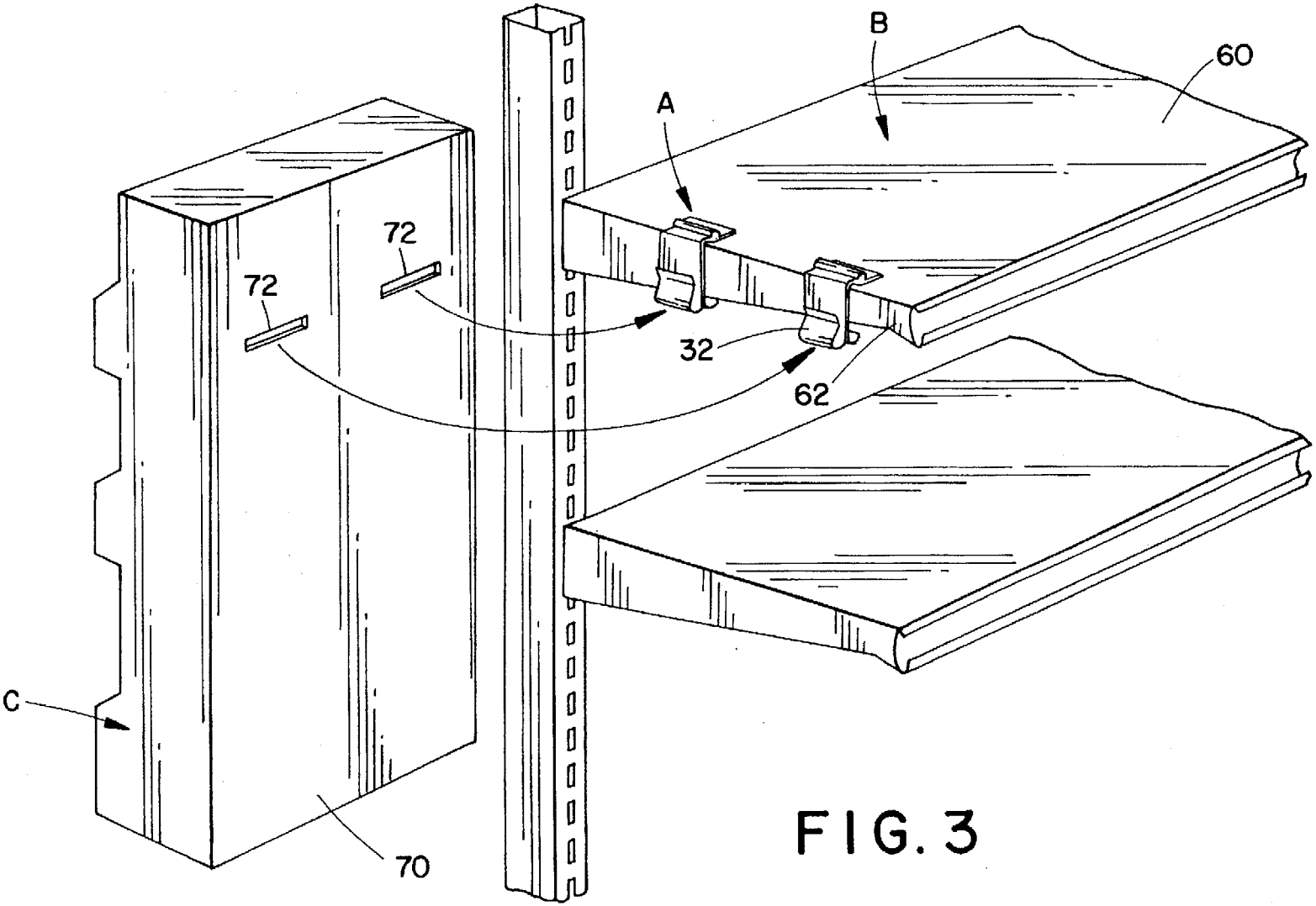
FIG. 3 is a perspective view on a reduced scale of a pair of hanger fixtures after they are secured on a store shelf and in the process of having a display rack mounted thereon.

With reference now to FIG. 3, the store shelf B is shown as having a pair of hanger fixtures A secured thereto in a spaced manner from each other. Now a suitable conventional display rack C can be mounted on the hanger fixtures. To this end, a rear face 80 of the display rack C has located therein a pair of horizontally-extending spaced slots 72. The hanger fixtures A are so spaced along the side wall 62 of the store shelf B that the slots 72 can allow the front walls 32 of the hanger fixtures A to protrude within the display rack C. The display rack is lowered on the hanger fixtures A until the edge of the back wall 70 overlying the slots 72 contact the bridges 30 of the pair of hanger fixtures. Gravity then holds the display rack C on the hanger fixtures A. In this way, the display rack is mounted on the store shelf B quickly and inexpensively. However, the display rack C is mounted in a sturdy manner to minimize the possibility that the display rack itself will swing or move laterally relative to the store shelf B.

Removal of the hanger fixtures A is facilitated by the design of the present invention. That is, the wing 18 can be pivoted counterclockwise around the hinge 16 so as to allow the wing to take its initial position as illustrated in FIG. 2A. The hanger fixture retains this position due to the memory of the resilient thermoplastic material from which the hanger fixture A is manufactured. Once this is accomplished, the hanger can be disconnected from the store shelf in a ready manner. With only the front wall 32 extending into the display rack C through the slots 72, it can be seen that the display rack can be lifted with minimal effort from the hanger fixtures and hence, the shelf.

With the hanger fixture A according to the present invention, no adhesive is necessary to fasten the hanger body 10 to a store shelf. This is advantageous from the standpoint that no layer of adhesive will be left on the store shelf nor will there be any damage caused to the store shelf by the removal of the hanger fixture therefrom. As can be seen from FIG. 3, the hanger fixture A according to the present invention will accommodate varying lengths of store shelf side walls 62 while still providing a locking engagement between the hanger fixture and the store shelf B when so desired.

The invention has been described with reference to a preferred embodiment. Obviously, modifications and alterations will occur to others upon reading and understanding this specification. It is intended to include all such modifications and alterations insofar as they come within the scope of the appended claims or the equivalents thereof.

We claim:

1. An integrally formed hanger fixture, comprising:

a substantially vertically oriented wall having a top end and a bottom end;

a substantially horizontally oriented wall connected to said top end of said vertical wall;

a front retainer wall connected to said bottom end of said vertically oriented wall and extending upwardly therefrom in a spaced substantially parallel manner;

a wing overlying said horizontally oriented wall; and, a hinge connecting said wing to said horizontally oriented wall, wherein said hinge enables said wing to pivot in relation to said horizontally oriented wall until said wing is disposed beneath said horizontally oriented wall.

2. The hanger fixture of claim 1 further comprising a layer of a friction material located on said wing.

3. The hanger fixture of claim 1 further comprising a rear retainer wall connected to said bottom end of said vertically oriented wall and extending upwardly therefrom in a spaced substantially parallel manner.

4. The hanger fixture of claim 3 wherein said rear retainer wall comprises a top extension which is positioned below said vertically oriented wall.

5. The hanger fixture of claim 4 further comprising a layer of a friction material located on said top extension.

6. The hanger fixture of claim 3 wherein said front retainer wall and said rear retainer wall each terminate in a lip.

7. The hanger fixture of claim 3 wherein the hanger fixture is formed from a resilient material.

8. An integrally formed hanger fixture for holding a display rack to a shelf, the hanger fixture comprising:

a substantially vertically oriented wall having a top end and a bottom end;

a substantially horizontally oriented wall connected to said top end of said vertical wall;

a front retainer wall connected to said bottom end of said vertically oriented wall and extending upwardly therefrom in a spaced substantially parallel manner;

a rear retainer wall connected to said bottom end of said vertically oriented wall and extending upwardly therefrom in a spaced substantially parallel manner;

a wing overlying said horizontally oriented wall; and, a hinge connecting said wing to said horizontally oriented wall, wherein said hinge enables said wing to pivot in relation to said horizontally oriented wall until said wing is disposed beneath said horizontally oriented wall.

9. The hanger fixture of claim 8 wherein said rear retainer wall comprises a top extension which is positioned below said vertically oriented wall.

10. The hanger fixture of claim 9 further comprising a layer of a friction material located on said top extension.

11. The hanger fixture of claim 10 further comprising a layer of a friction material located on said wing.

12. The hanger fixture of claim 8 wherein said front retainer wall and said rear retainer wall each terminate in a lip.

13. The hanger fixture of claim 12 wherein said layer of friction material on said wing and said layer of friction material on said top extension face each other when said wing is pivoted so that it underlies said horizontally oriented wall.

14. In combination, a display rack including a substantially upright rear wall having at least one horizontal slot formed therein and a hanger fixture for supporting the display rack, said hanger fixture comprising:

a substantially vertically oriented wall having a top end and a bottom end;

a substantially horizontally oriented wall connected to said top end of said vertical wall;

a front retainer wall connected to said bottom end of said vertically oriented wall and extending upwardly therefrom in a spaced substantially parallel manner;

a wing overlying said horizontally oriented wall; and, a hinge connecting said wing to said horizontally oriented wall, wherein said hinge enables said wing to pivot in relation to said horizontally oriented wall until said wing is disposed beneath said horizontally oriented wall wherein said front retainer wall is dimensioned to be readily received in and passed through said slot on said rear wall of said display rack to thus interconnect the rack and the hanger fixture.

15. The combination according to claim 14 further comprising:

a rear retainer wall connected to said bottom end of said vertically oriented wall and extending upwardly therefrom in a spaced substantially parallel manner.

16. The combination of claim 14 wherein said rear retainer wall comprises a top extension which is positioned below said vertically oriented wall.

17. The hanger fixture of claim 16 further comprising:

a layer of a friction material located on said wing; and a layer of a friction material located on said top extension, wherein said layer of friction material on said wing and said layer of friction material on said top extension face each other when said wing is pivoted so that it underlies said horizontally oriented wall.

18. The hanger fixture of claim 15 wherein said front retainer wall and said rear retainer wall each terminate in a lip, said lip being dimensioned to be readily received and passed through said slot on said rear wall of said display rack.

19. The combination of claim 15 further comprising:

a first gap defined between said front retainer wall and said vertically oriented wall; and a second gap formed between said rear retainer wall and said vertically oriented wall.

20. The combination of claim 14 wherein said hanger fixture is of one piece and is formed from a resilient material that enables said hinge to pivot said wing in relation to said horizontally oriented wall and also enables said rear retainer wall to move in relation to said vertically oriented wall.

* * * * *